United States Patent [19]

Grainger et al.

[11] 4,238,951

[45] Dec. 16, 1980

[54] PORTABLE AUTOMOBILE STRAIGHTENING DEVICE

[75] Inventors: James D. Grainger; Harold A. Grainger, both of Wichita, Kans.

[73] Assignee: Grainger Bros., Inc., Wichita, Kans.

[21] Appl. No.: 948,019

[22] Filed: Oct. 2, 1978

[51] Int. Cl.[3] ..... B21D 1/12; B25B 5/14; B23Q 9/02

[52] U.S. Cl. ..... 72/457; 72/705; 269/114; 29/559

[58] Field of Search ..... 72/705, 457; 269/114; 29/559

[56] References Cited

U.S. PATENT DOCUMENTS

| | | | |
|---|---|---|---|
| 2,340,587 | 2/1944 | Graham | 72/705 X |
| 2,542,836 | 2/1951 | Porter et al. | 72/705 X |
| 2,646,101 | 7/1953 | Ferguson | 72/705 X |
| 3,007,509 | 11/1961 | Eck | 72/705 X |
| 3,088,513 | 5/1963 | Marquardt | 72/705 X |
| 3,501,938 | 3/1970 | Sprague | 72/705 X |
| 3,921,433 | 11/1975 | Whitney | 72/705 X |
| 4,023,394 | 5/1977 | Borup | 72/705 X |

FOREIGN PATENT DOCUMENTS

| | | | |
|---|---|---|---|
| 1953868 | 7/1966 | Fed. Rep. of Germany | 72/705 |
| 2246883 | 4/1974 | Fed. Rep. of Germany | 72/705 |
| 2606806 | 8/1977 | Fed. Rep. of Germany | 72/705 |
| 2364708 | 5/1978 | France | 72/705 |
| 338753 | 9/1971 | Sweden | 72/705 |
| 1323163 | 7/1973 | United Kingdom | 72/705 |

*Primary Examiner*—Lowell A. Larson
*Attorney, Agent, or Firm*—Edward L. Brown, Jr.

[57] ABSTRACT

An apparatus and method for straightening damaged unibody-type vehicles whereby a lightweight rectangular frame is attached at its four corners to the longitudinal pinch weld which runs along both sides of the vehicle body. The frame members are rigidly connected to each other but telescopingly adjustable in length to accommodate different size vehicles and have pulling attachment points at the corners of the frame allowing pulling or pushing in any direction.

5 Claims, 7 Drawing Figures

PORTABLE AUTOMOBILE STRAIGHTENING DEVICE

BACKGROUND OF THE INVENTION

This invention relates in general to force-supplying devices for straightening and pulling unitized car bodies. More specifically, the invention relates to straightening of automobile bodies of the unibody type by the use of a lightweight rectangular frame which is attached to the underside of the vehicle at the four corners of the frame by individual clamping means. The clamps grip the pinch welds which run along both sides of the vehicle body approximate the outer edge. After the frame has been clamped to the vehicle, conventional force-transmitting devices such as cylinders, lever arms and chains are attached on the frame at various attachment points so that the body can be pulled or pushed, depending upon the precise damage.

DESCRIPTION OF THE PRIOR ART

The straightening of car bodies having conventional frames is a relative easy process since the straightening means can be attached directly to the frame which is far stronger than the remaining structure of the body and pulled back in place without any damage to the frame. In unitized bodies, also referred to as unibody structures, this is not possible since there is no frame on the vehicle and the various attachment points are no stronger than the portion of the body that has been collapsed. With prior art methods, when a unibody structure is pulled back in shape there is usually additional damage to the body made at the pulling points due to the lightweight metal surrounding those points which must be additionally repaired. Also, another unsatisfactory prior art method is to first weld onto the vehicle body an attaching point, which later must be cutaway once the vehicle is repaired. This latter method is not only more time consuming, but also creates a certain amount of damage on the vehicle due to the welding required.

The most widely used method of repairs in unibody structures is the last mentioned technique of welding on an attachment point and later removing same. Another method is shown in U.S. Pat. No. 3,108,629 dated Oct. 29, 1963, wherein a pair of gripping jaws are mounted on a T-shaped frame for gripping the pinch welds on opposite sides of the car or on the same side. This design certainly gives a greater contacting area on the vehicle body for transferring the pulling load; however, the present invention enlarges the contacting area even further with four contacting points, two on each side of the vehicle. If it is desirous to pull a portion of the damaged vehicle in a second direction, as illustrated in FIGS. 3 and 4 of Jenkins, it is necessary to completely change the setup of the apparatus whereas in the present invention the frame is not moved and a second setup is not required. Another apparatus used on unibody vehicles is shown in U.S. Pat. No. 3,091,278 dated May 28, 1963, which also illustrates a single bar structure having gripping means at opposite ends of the bar.

It is therefore the principal object of the present invention to provide an improved straightening frame which is readily portable and lightweight and provides a four-point clamping pattern so as to reduce the attachment point loadings on the body and allow the vehicle body to be pulled in any horizontal direction with a single setup.

Another object of the present invention is to provide a straightening frame which is rectangular in shape having telescoping sides and ends so as to accommodate varying size vehicles and rigid corners on the frame so that the various pulling loads can be equally distributed to all four clamping points on the frame.

Another object of the present invention is to provide a lightweight straightening frame which can be quickly attached to the pinch welds of a unibody structure by a single person from one side of the car by expanding the end members of the frame until the inner jaws of the clamping means are wedged between the pinch welds on opposite sides of the vehicle.

A further object of the present invention is to provide a unique method of attaching a straightening frame to a unibody structure.

BRIEF DESCRIPTION OF THE DRAWINGS

Further objects of the invention, together with additional features contributing thereto and advantages accuring therefrom, will be apparent from the following description of an embodiment of the invention when read in conjunction with the accompanying drawings, wherein.

DESCRIPTION OF THE PREFERRED EMBODIMENT

Figure 1:
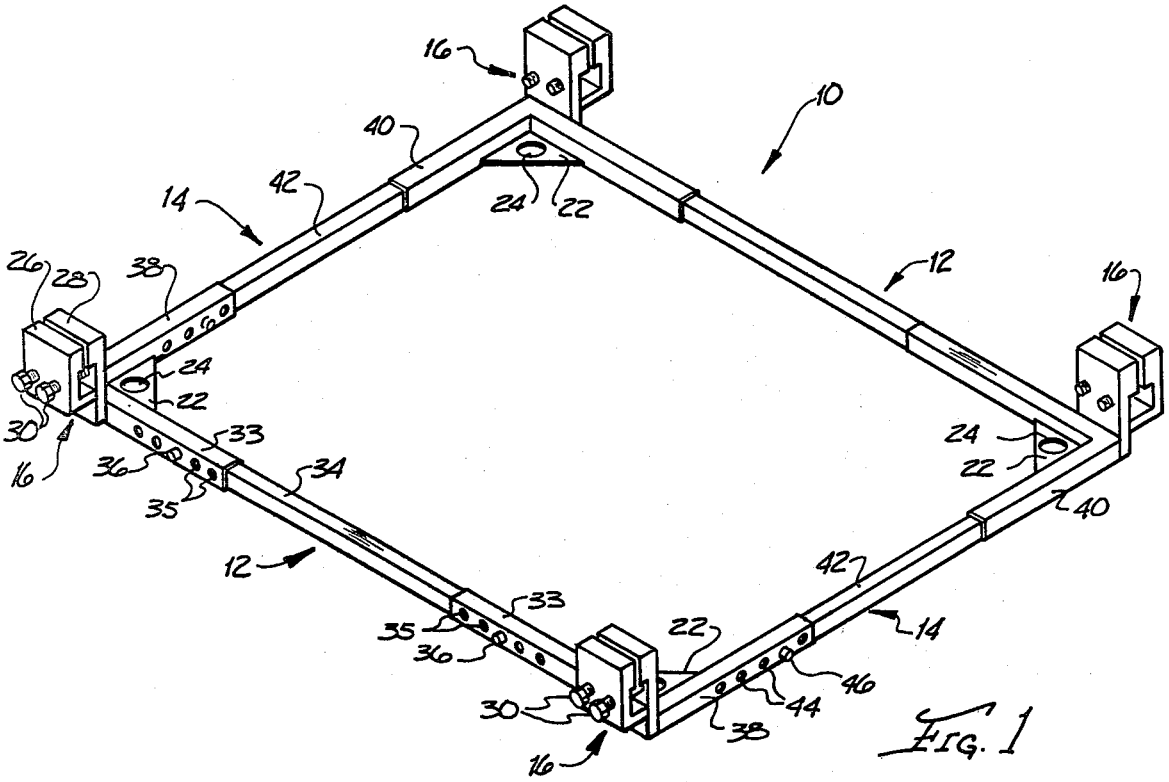
FIG. 1 is a perspective view of the straightening frame.

Referring now to FIG. 1, the rectangular straightening frame of the present invention is generally referred to by reference numeral 10. The frame 10 is constructed of tubular steel including two side members 12 joined by two end members 14. Located at each corner of frame 10 is a clamping device 16 which is attached to the side member 12 by welding or other means. Also located at each corner of the frame between respective side member 12 and end member 14 is a triangular gusset plate 22 providing diagonal rigidity to the frame and including openings 24 for attaching any type of pulling device.

Each clamping device 16 includes an outer jaw member 26 facing an inner mating jaw member 28 maintained in alignment with each other by a pair of bolts 30. Outer jaw member 26 has an offset leg portion 32 which provides a fulcrum point for drawing the two jaw members into gripping relation by bolts 30. The leg portion of inner jaw member 28 extends downwardly and is welded to frame member 12.

Side frame member 12 is of a square tubular cross section and includes two outer sections 33 telescoped over a center section 34 having a slightly smaller out-side dimension so as to slide freely inside either of the outer sections 33. Longitudinally spaced on outer sections 33 are a plurality of holes 35 for receipt of a locking pin 36 which locks the outer sections and center section together as a rigid member.

Figure 4:
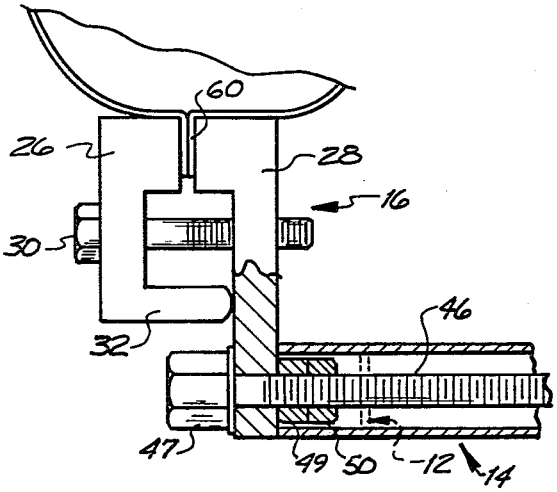
FIG. 4 is an enlarged fragmentary view of one of the clamping means at the corner of the frame attached to the vehicle body.

The end members 14 of the frame 19 are also made up of telescoping tubular members including outer sections 38 and 40 telescoping over a center section 42. Outer section 38 includes a series of longitudinally spaced holes 44 which receive a locking pin 36 for adjustably locking the center section 42 to the outer section 38. The positioning of pin 36 sets the rough or approximate frame width for the car which is to be attached. Outer section 40 telescopes over center section 42 and is adjustably positioned by a jack screw 46 concentrically positioned within the end member 14. Jack screw 46 has a driving lug nut 47 located at the outer end of the screw for rotating same and providing a fine adjustment between the clamping devices 16 located at oposite sides of the frame. Jack screw 46 is threadably received in a fixed nut 48 attached to the outer end of center section 42 while the outer end of jack screw 46 is rotatably journaled in outer section 40 and prevented from any longitudinal movement in outer section 40 by lug nut 47 and a pair of backup nuts 49 and 50, as best seen in FIG. 4.

Figure 5:
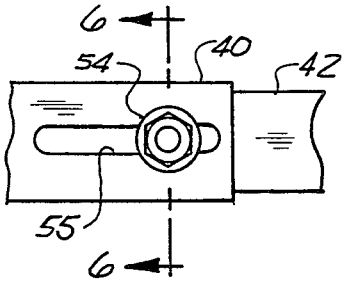
FIG. 5 is a fragmentary elevational view of one of the end members of the frame showing a modified form of extension means.
Figure 6:
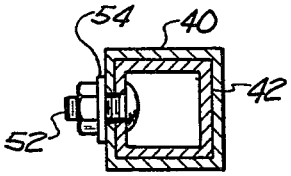
FIG. 6 is a sectional view taken along lines 6—6 of FIG. 5.

FIGS. 5 and 6 illustrate a modified form of adjusting the length of end member 14 in place of jack screw 46. By loosening the nut on bolt 52, gripping washer 54 releases its grip on the sides of slot 55 allowing outer section 40 to move relative to center section 42.

Figure 7:
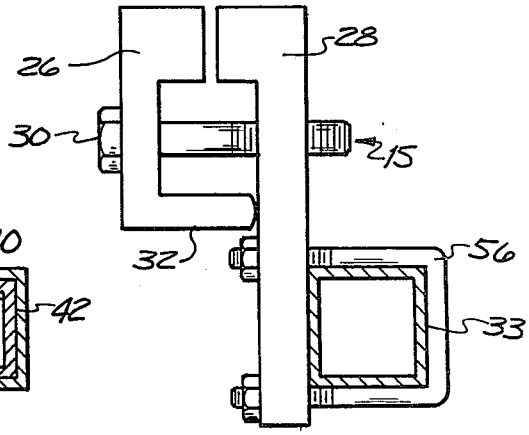
FIG. 7 illustrates a modified form of clamp attachment to the rectangular frame.

FIG. 7 illustrates a modified type of clamping device which can be additionally added to the outer sections 33 of side frame members 12 and can be adjustably attached thereto by a pair of u-bolts 56.

OPERATION

Figure 2:
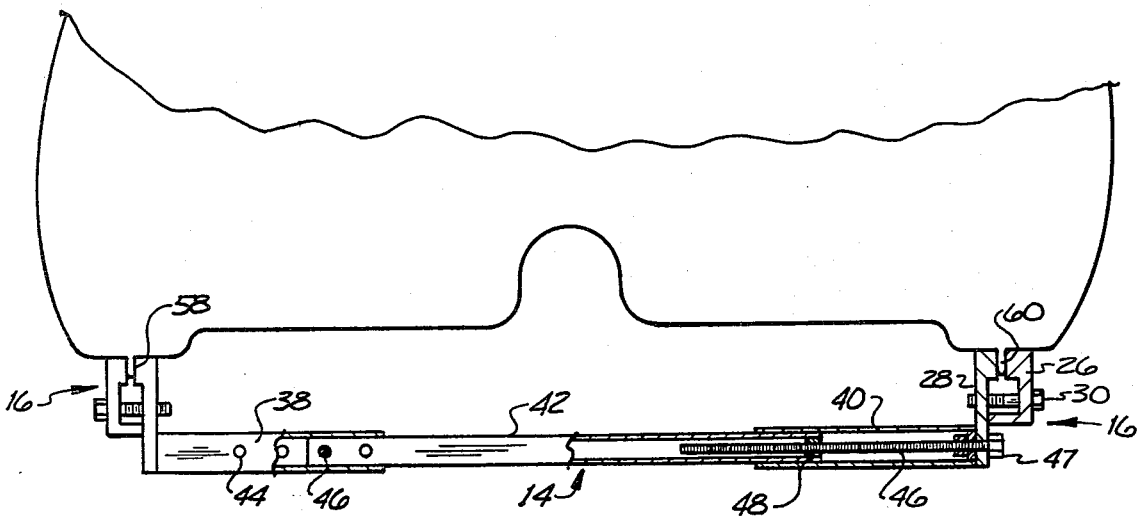
FIG. 2 is a sectional view taken along lines 2—2 of FIG. 3, with portions of the frame and members broken away to illustrate the adjusting structure.
Figure 3:
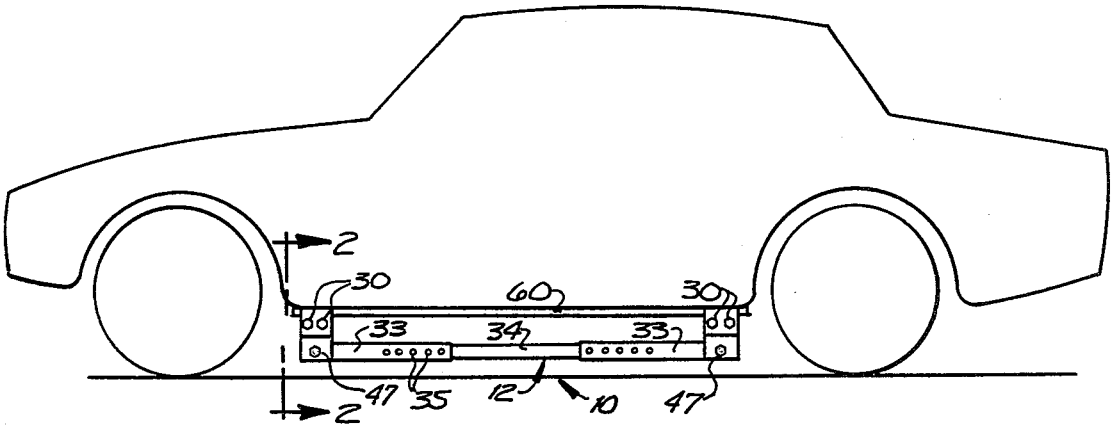
FIG. 3 is a side elevational view of the straightening frame attached to the pinch welds of a unibody car structure.

Most unitized body cars have two pinch welds 58 and 60 which run longitudinally along the outer edges of the underside of the vehicle, as seen in FIGS. 2, 3 and 4. The pinch weld joins the rocker panel with the under panel of the body structure and provides the strongest or most rigid point on the body of the car, since the car has no conventional frame. The straightening frame 10 of the present invention is slid under the vehicle, as seen in FIG. 3, and adjusted to approximately fit the size of the particular vehicle. The side members 12 are adjusted in length by removal of pins 36 and telescoping the sections 33 and 34 either in or out so that the clamping devices 16 can grip at that point along the pinch weld which is the strongest position, such as the jack point. The end members 14 of the frame are adjusted to roughly fit the width dimension between the pinch welds 58 and 60 by means of locking pin 36. All of the jaw members 26 and 28 are wide open before the frame 10 is attached to the vehicle. With the frame blocked-up off the floor in contacting relationship with the undersurface of the car body, the jaw members 28 are moved outward by the rotation of lug nuts 47 until jaw members 28 come in contact with the inside surface of pinch welds 58 and 60. Lug nuts 47 are quickly rotated by the use of conventional impact hammers used in the trade. By extending the end members 14 of the frame until the inner jaws 28 of the clamping means are wedged between the pinch welds on opposite sides of the vehicle, the frame is temporarily positioned in place. With the frame 10 in place, the workman then individually tightens each clamping device 16 by torquing down both bolts 30 until inner and outer jaw members 28 and 26 tightly grip the pinch weld. This method of attachment can be performed by a single workman without the necessity of holding the frame in place while the individual clamping devices 16 are tightened onto the pinch weld. This method also prevents the possibility of bending the opposing pinch welds inwardly towards each other and deforming portions of the car body. Once the frame 10 is rigidly attached at each clamping device 16, any of the various force-transmitting tools of the trade can be attached to one or more of the attachment openings 24 located in the corners of the frame. Due to the four-point mounting of the frame, the load is equally spread over the body and it is possible to pull the vehicle body in any horizontal direction without resetting the frame. If an additional clamping device 16 is desired on a particularly weak body structure, the additional clamping device 15, shown in FIG. 7, can be attached to either one of the outer sections 33 of the side members of the frame to add additional gripping area.

When using the modified form of expansion of end members 14, as shown in FIGS. 5 and 6, it is necessary that the bolt 52 be left loosened while each of the individual clamping devices 16 are brought into gripping engagement with the pinch welds. After each bolt 30 is torqued down, then the bolt 52 may be tightened so that side member 14 becomes a rigid structure and any side loads applied to one clamping device are spread to the opposing clamping device on the opposite side of the car.

While the instant invention has been shown and described in what is conceived to be the most practical embodiment, it is recognized that departures may be made therefrom within the scope of the invention which is therefore not to be limited to the details disclosed herein, but is to be accorded the full scope of the claims so as to embrace any and all equivalent apparatus and methods of attachment.

What is claimed is:

1. Apparatus for clamping a damaged unibody vehicle structure for purposes of straightening, which is adapted to be manually secured to the underside of the vehicle body along the pinch welds, comprising:

a lightweight rigid rectangular frame constructed of two parallel side members and two parallel end members, the ends of each side member being attached to the ends of each end member forming a corner;

a gusset plate attached to each corner forming a rigid joint, and attachment point means on the gusset plate for supporting force applying apparatus; said side and end member including telescoping means therein to vary the length of said members, the telescoping means on the end members includes at least two sections, a jack screw anchored between the two sections with an exposed lug nut thereon for turning the screw into a fixed nut attached to one of said sections;

locking means on each telescoping means for preventing any telescoping movement between said sections; and clamping means attached to the frame at each corner thereof adapted to grip the pinch weld along each side of the vehicle body, the clamping means and frame being sufficiently shallow in depth and light in weight to be manually mounted to an unelevated vehicle.

2. The apparatus of claim 1, wherein the clamping means at each corner of the frame comprises a pair of mating inner and outer jaw members with the inner jaw member anchored to the frame and the outer jaw member anchored to the inner jaw member.

3. The apparatus of claim 1, wherein each frame end member includes a plurality of telescoping sections and the locking means comprises a slot in one of the sections and a releasable bolt passing through said slot and the companion telescoping section adapted to lock said two sections against relative movement.

4. The apparatus of claim 1, wherein the clamping means at each corner of the frame comprises a pair of mating jaw members one being anchored to the frame and positioned normal to the longitudinal axis of the end members and in a common gripping plane with the clamping means at the opposite end of the adjacent side member.

5. A method of attaching a rectangular straightening frame with telescoping end members and four clamping means each including an inner and outer jaw member, one at each corner, to the undersurface of a unibody structure having pinch welds running longitudinally along the opposite sides of the body comprising the steps of:

opening each individual clamping means;

expanding the end members to an approximate position so that the clamping means on opposite sides receives the pair of pinch welds;

expanding the end members until the inner jaws of each clamping means come in wedging contact against the inside surface of the opposing pinch welds, thereby holding the frame in place; and closing the outer jaw member of each clamping means thereby gripping the pinch weld between said inner and outer jaws to rigidly hold the frame.

* * * * *